US006478649B1

(12) United States Patent
Hoback

(10) Patent No.: US 6,478,649 B1
(45) Date of Patent: Nov. 12, 2002

(54) FLEXIBLE SPACE STRUCTURE CONSTRUCTION CONNECTOR FOR VARIABLY SIZED BUILDING ELEMENTS

(75) Inventor: John F. Hoback, 9551 Albatross Dr., Anchorage, AK (US) 99502-1659

(73) Assignee: John F. Hoback, Anchorage, AK (US)

( * ) Notice: Subject to any disclaimer, the term of this patent is extended or adjusted under 35 U.S.C. 154(b) by 0 days.

(21) Appl. No.: 10/126,717

(22) Filed: Apr. 19, 2002

(51) Int. Cl.[7] ..... A63H 33/04
(52) U.S. Cl. ..... 446/85; 446/126
(58) Field of Search ..... 446/85, 105–109, 446/113–116, 118–124, 126, 475; 273/156, 159

(56) References Cited

U.S. PATENT DOCUMENTS 1,192,039 A * 7/1916 Converse
1,446,868 A * 2/1923 Baker
1,920,021 A * 7/1933 Schroeder
2,523,239 A * 9/1950 Tinnerman
3,176,428 A * 4/1965 Slingluff
3,648,404 A * 3/1972 Ogsbury et al. ..... 46/29
3,830,011 A * 8/1974 Ochrymowich ..... 46/28
4,078,328 A * 3/1978 Rayment ..... 46/29
4,787,191 A * 11/1988 Shima ..... 52/648
5,049,105 A * 9/1991 Glickman ..... 446/126
5,199,919 A * 4/1993 Glickman ..... 446/126
5,318,470 A * 6/1994 Denny ..... 446/126

* cited by examiner

*Primary Examiner*—Derris H. Banks
*Assistant Examiner*—Jamila Williams
(74) *Attorney, Agent, or Firm*—Donald W. Meeker

(57) ABSTRACT

A number of connectors each have a central hub and flexible arms radiating out from the hub, which may interlock orthogonally with other hubs or structural members. A twist in the flexible arms permits axial flexing in addition to the lateral flexing capability in all directions. Distal receiving ends of the flexible arms have laterally expanding and contracting flexible loops, arms, coils, sleeves, cables, or spring-loaded forked arms capable of contracting and expanding from two to ten times the thickness of the flexible arms to accommodate a wide range of sizes of tubes attachable to the flexible arms. Various colors, lengths, and diameters of inexpensive drinking-type straws may connect between connectors to form a wide variety of structural shapes.

20 Claims, 10 Drawing Sheets

FLEXIBLE SPACE STRUCTURE CONSTRUCTION CONNECTOR FOR VARIABLY SIZED BUILDING ELEMENTS

BACKGROUND OF THE INVENTION

1. Field of the Invention

The present invention relates to space structure construction systems and in particular to a space structure construction system using flexible star-like joints which can be interlocked with a wide range of tubular elements having different diameters to fabricate three dimensional space structures with straight and curved configurations and which are capable of interlocking inexpensive straws.

2. Description of the Prior Art

Construction systems have fascinated children of all ages for all time. Most construction systems have preset elements which fit together often in a limited variety of arrays. And often today the construction pieces are designed for fabricating a single three dimensional figure.

Various space structure construction systems have been patented. Generally they use a unique connector to which numbers of the same size and shape building elements can be connected to form structures, normally three dimensional in shape. A number of them provide connectors to which hollow tubular building elements may be attached, all of the same internal diameter to fit on the same size protrusions from the central hub of each connector.

U.S. Pat. No. 3,176,428, issued Apr. 6, 1965 to Slingluff, provides flexible resilient straws bendable into loop configurations connected at each end to adjacent rigid spokes around a central rigid hub simulating a propeller as well as other shapes simulating building arch ways and other types of structures. There is no suggestion of inserting the loops into tubes.

U.S. Pat. No. 4,787,191, issued Nov. 29, 1988 to Shima, shows a somewhat flexible flat connector element shaped like a ships wheel on an old sailing ship with short spokes protruding outwardly from a circular rim have an inner opening. Tubular elements are connected at one end to the spokes of one connector and at the other end to the spokes of another connector in multiplicity to create three dimensional space frame structures. Elements can interconnect through the inner opening of the connector.

U.S. Pat. No. 3,648,404, issued Mar. 14, 1972 to Ogsbury, claims a three dimensional connector unit having radial arms extending in X, Y and Z directions with slotted ends to receive tubular members press fit onto the arms to form three dimensional space frame structures.

U.S. Pat. No. 5,049,105, issued Sep. 17, 1991 to Glickman, describes an injection molded flat hub connector having a radial spokes configuration with slotted spokes to receive tubular elements, such as straws, press fit onto the spokes to form three dimensional space frame structures. A central circular rim in the hub can also receive tubular elements connected thereto expanding the structure into the third dimension.

U.S. Pat. No. 4,078,328, issued Mar. 14, 1978 to Rayment, discloses a flat connector unit having a central circular opening therethrough and radiating arms having bulbous outer ends to receive deformable plastic tubes connected to the bulbous ends so that the tubes may be rotated around the arms. Tubular elements may be inserted through the central opening to expand the structure to three dimensions.

U.S. Pat. No. 5,318,470, issued Jun. 7, 1994 to Denny, indicates a modular building assembly having a donut shaped hub with rounded protuberances extending therefrom around the outer circular edge to receive tubular members attached thereto. It also includes hemispheres with rounded protuberances attachable to each side of the hub to create a hemispheric hub with rounded protuberances extending outwardly in all directions to create three dimensional space frame structures when interconnected with other hubs using the tubular members.

U.S. Pat. No. 3,830,011, issued Aug. 20, 1974 to Ochrymowich, puts forth deformable extruded tubular rods connected to deformable sheet material connectors stamped out of thermoplastic in various configurations with a varied number of arms extending from a central hub. The flexibility of the rods and the connectors enables three dimensional space frame structures.

There is a need for a connector which can receive a wide variety of sizes of tubular building elements to create more variety in the construction and permit the use of diverse elements, such as straws which are inexpensive to buy in quantity and can be found in a wide variety of diameters, lengths, and colors.

SUMMARY OF THE INVENTION

An object of the present invention is to provide a space structure construction connector which has a spoke-like array of flexible arms that can receive a wide variety of sizes of tubular building elements attached to the arms for creating structures.

Another object of the present invention is to provide a central opening in the connector for receiving a two-armed connector element or a tubular building element therein for extending the structure in three dimensions.

One more object of the present invention is to provide a spoke-like array flexible arms for receiving straws which can be purchased inexpensively in bulk to extend the use of the space structure construction kit considerably.

An additional object of the present invention is to provide a connector having a spoke-like array of flexible arms, each capable of bending in any direction to allow curved or other unusually shaped constructions.

In brief, a connector has a central circular hub with an opening therethrough and a series of flexible arms radiating out from the hub in a spoke-like array. The connectors may have any number of spaced radiating arms, including 2–10 arms, as well as two in the connector inserted through the central hub opening.

Each arm may be a loop of flexible material for receiving an end of a tubular building element pressed over the arm compressing the loop, which then exerts an outwardly directed friction force on the inner walls of the tubular element to retain the element in place. Other possible arm configurations include a rod having an end cap and a movable washer element capable of moving along the rod to compress a flexible material between the cap and the washer, causing the flexible material to expand to exert a retaining force on a tubular building element inserted over the arm. Variations for the flexible material encircling the rod include a nylon coil spring, expansible accordion plastic or rubber, a nylon loop with ribbed grips, expansion plastic rubber or foam, a series of strips of nylon cable, a series of flexible arms radiating out from the rod, or other flexible material. The arm may also be a spring-loaded split arm (nylon) having an encircling rubber grip material.

The base of each arm adjacent to where it connects to the central hub may have a portion of nylon or other flexible material twisted by heat forming to a ninety or one-hundred-eighty degree twist to make the arm more flexible and allow each arm to bend in any direction for forming interesting structural shapes.

The two-armed connector part that is inserted through the central circular hub opening may be provided with a clipping mechanism, such as flexing plastic arms with a protruding retaining portion, so the two-armed connector part may be inserted into the central hub opening and locked in place by the protruding retaining portion which bends inwardly as the two-armed connector passes through the central hub and then clicks outwardly to lock the two-armed connector part in place in the central hub opening, thereby creating a combined connector with arms extending in a variety of directions for building three dimensional constructions.

An advantage of the present invention is that it has the flexibility of arm movement to create a wide variety of three dimensional structures.

Another advantage of the present invention is that it has flexible retaining portions on each arm so that each arm has the ability to receive and retain a wide variety of sizes and shapes of open-ended building elements attached thereto.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
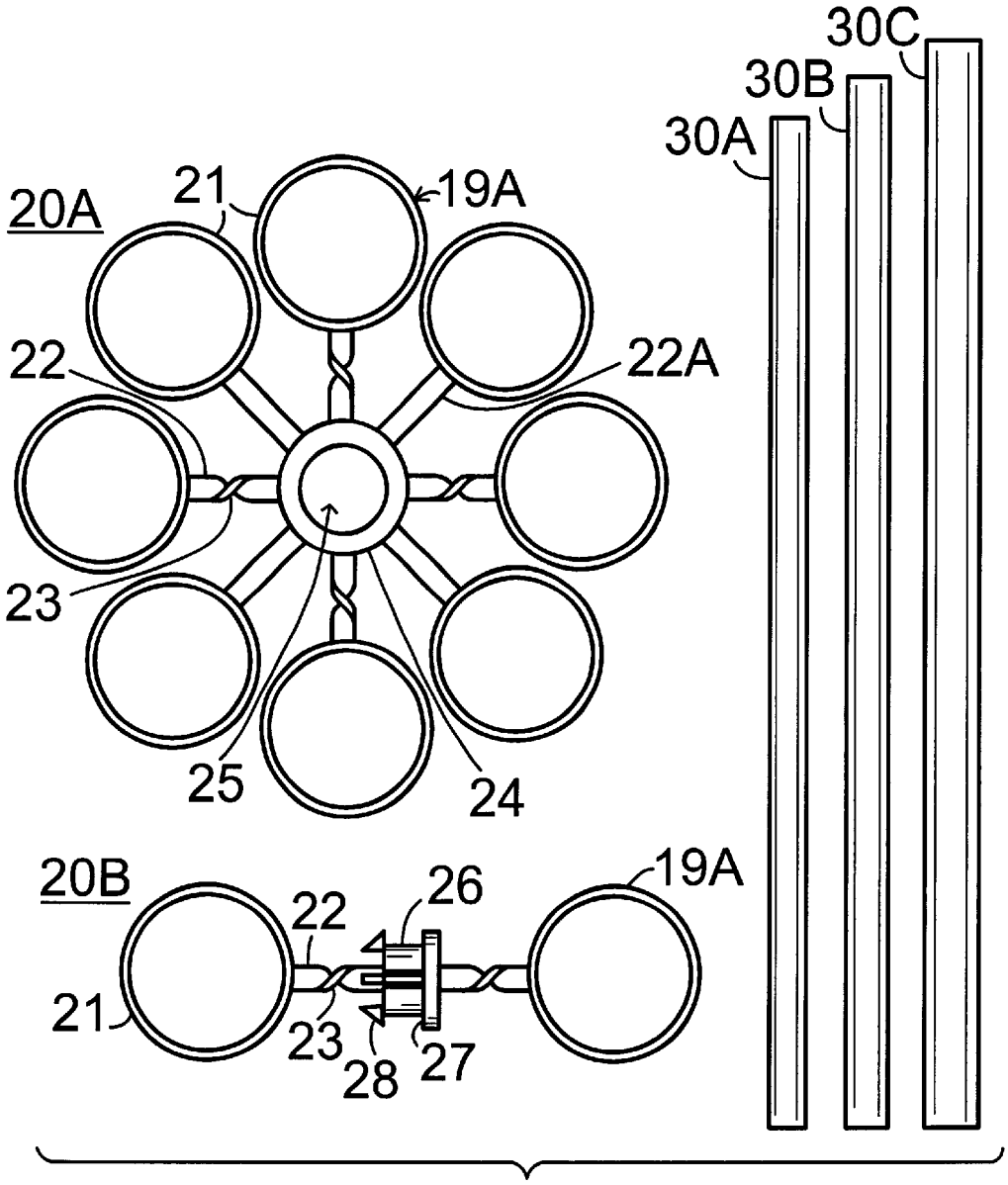
FIG. 1 is a plan view showing a multi-armed connector, with some arms having a twist and some arms straight, and a two-armed connector which connectors may be interlocked orthogonally and a number of variously sized tubular building elements attachable to each arm of the connectors.
Figure 2:
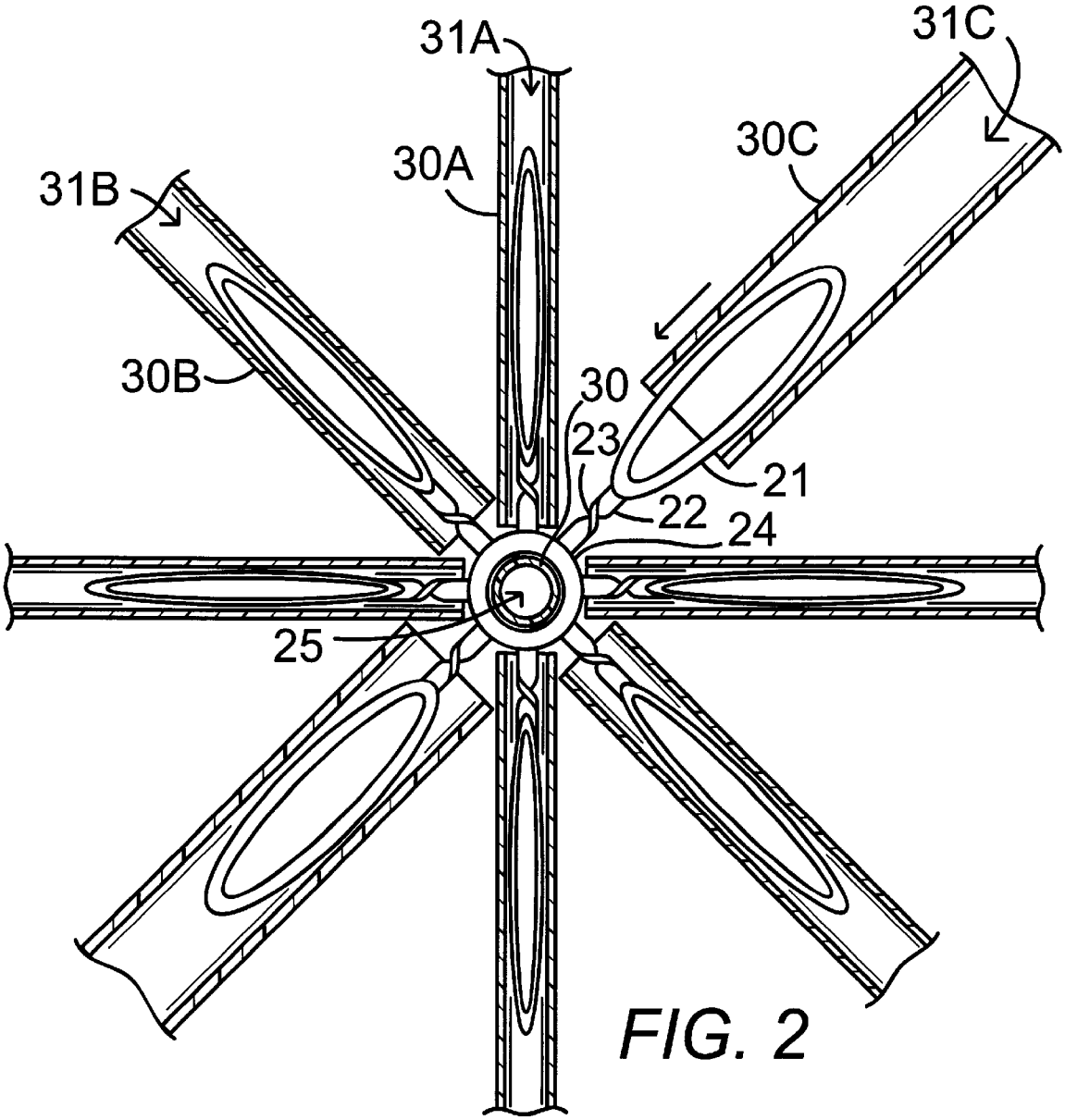
FIG. 2 is a plan view in partial section of the multi-armed connector of FIG. 1 having a variety of differently sized tubular elements attached to the arms of the connector and a tubular building element through the central opening in the hub of the connector.

In FIGS. 1 and 2 a flexible modular construction system comprises an assortment of elongated building members 30A, 30B, and 30C of various sizes having an opening 31A, 31B, and 31C at each end and a number of connectors 20A and 20B each having a central hub 24 and 26 supporting at least two flexible arms 22 and 22A attached to the hub and extending outwardly from the hub in a spaced array.

The flexible arms 22 and 22A are capable of flexing in various directions and the flexible arms each having a laterally expansible and contractible distal receiving end 19 capable of a lateral expansible and contractible range of motion (shown by arrows in FIGS. 7–16) equal to at least double the thickness of the flexible arm so that each receiving end is capable of receiving and retaining any of a variety of the building members 30A, 30B, and 30C having varying sizes of end openings 31A, 31B, and 31C.

Each of the flexible arms 22 and 22A is formed of flexible material, some straight arms 22A may be round or square or otherwise shaped in cross-section along their length and the other twisted arms 22, preferably flat rectangular in cross-section have at least one heat formed twist 23 along its length so the flexible arm is capable of flexing axially as well as laterally over a wide range of motion.

Figure 3:
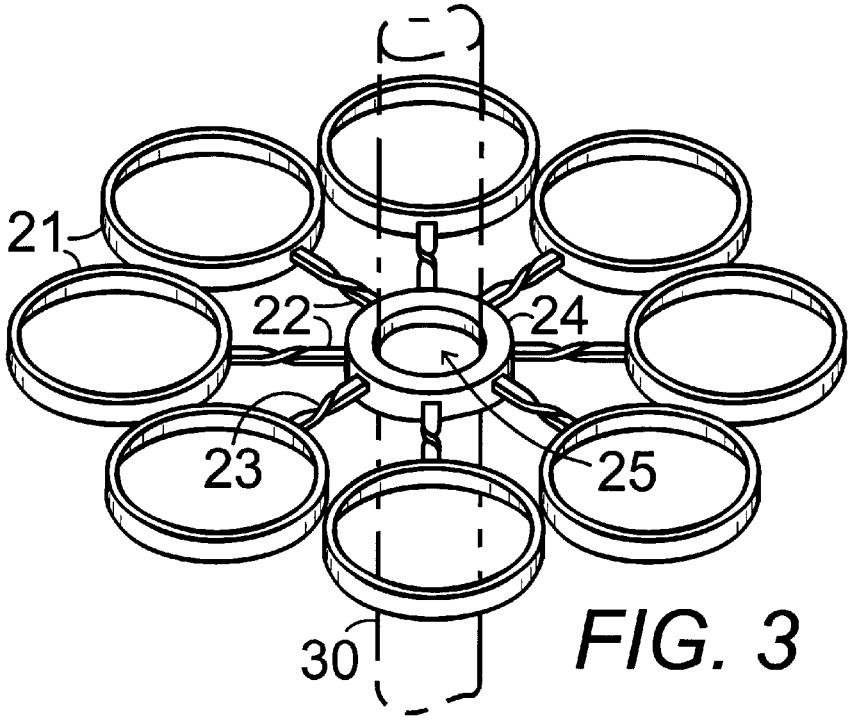
FIG. 3 is a perspective view of the multi-armed connector of FIG. 1 having a tubular connector through the central opening in the hub of the connector.

In FIGS. 1, 2 and 3 the multi-armed connector hub 24 is provided with a hub opening 25 transversely therethrough and a building element 30 is insertable therethrough with a tight friction fit to expand the construction in a direction orthogonal to the connector.

Figure 4:
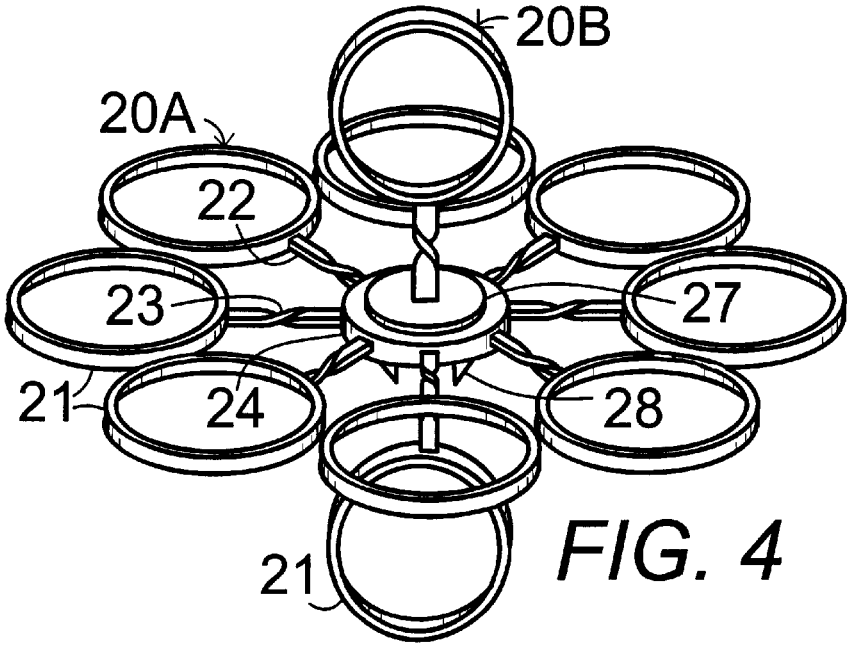
FIG. 4 is a perspective view of the multi-armed connector of FIG. 1 having the double-armed connector of FIG. 1 through the central opening in the hub of the connector.

In FIGS. 1 and 4, a first hub 24 of the multi-armed connector 20A is provided with a hub opening 25 transversely therethrough and a second hub 26 of the two-armed connector 20B is insertable through the hub opening 25 and securable therein by a removable locking means, such as flexible triangular tipped tabs 28 which bend to insert into the hub opening 25 and snap open to lock the two-armed connector 20B inside the hub of the multi-armed connector 20A (seen in FIGS. 1, 1A, 1B and shown interconnected in FIGS. 4, 4A and 17) or a removable locking means, such as a protruding nib 10 on a flexible portion of the hub 26 having a lateral hub opening 9 therethrough for better molding and to allow flexing at an end of a two-armed connector hub 26 (seen in FIGS. 1C, 1D and 1E) to snap lock after passing through the hub opening 25 of the multi-armed connector 20A to form a combined connector having the flexible arms of the second hub extending orthogonally to the first hub.

Figure 1A:
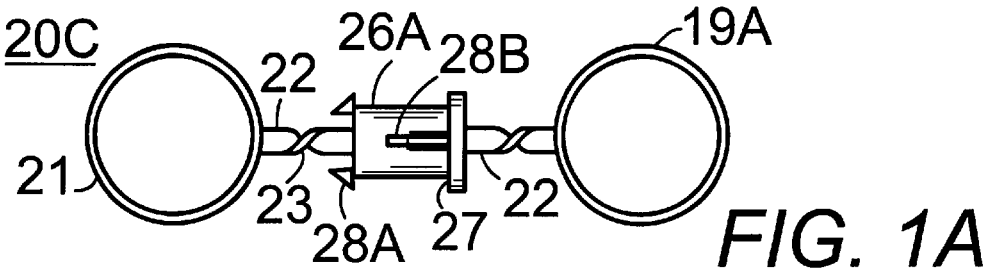
FIG. 1A is a plan view showing the orthogonal connector having two arms and an elongated center portion with double sets of flexible tabs for snap fitting into the openings in the hubs of two of the multi-armed connectors.
Figure 1B:
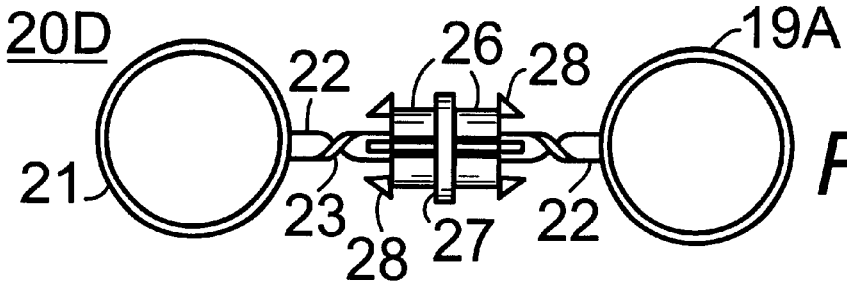
FIG. 1B is a plan view showing the orthogonal connector having two arms and a center portion having a double ended snap connector for snap fitting with flexible tabs into the opening in the hub of two of the multi-armed connectors.
Figure 1C:
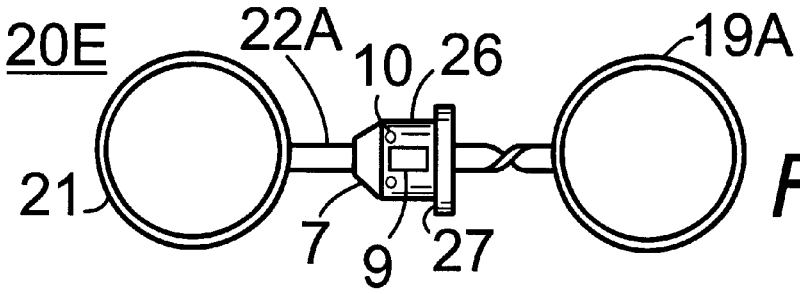
FIG. 1C is a plan view showing the orthogonal connector having two arms and a center portion for snap fitting with a protruding nib engageable to an edge of the hub opening of the multi-armed connector.
Figure 1D:
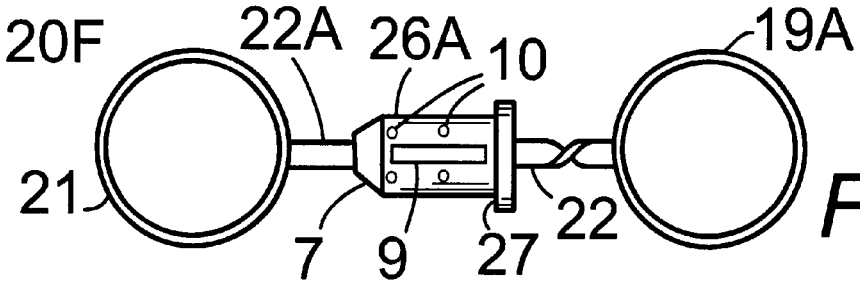
FIG. 1D is a plan view showing the orthogonal connector having two arms and an elongated center portion with double sets of protruding nibs engageable with the edge of the hub openings for snap fitting into the hubs of two of the multi-armed connectors.
Figure 1E:
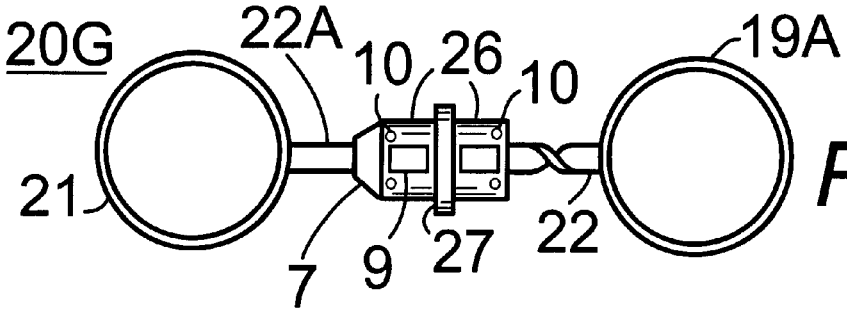
FIG. 1E is a plan view showing the orthogonal connector having two arms and a center portion having a double ended snap connector for snap fitting with protruding nibs engageable with the edge of the hub openings into the hubs of two of the multi-armed connectors.
Figure 4A:
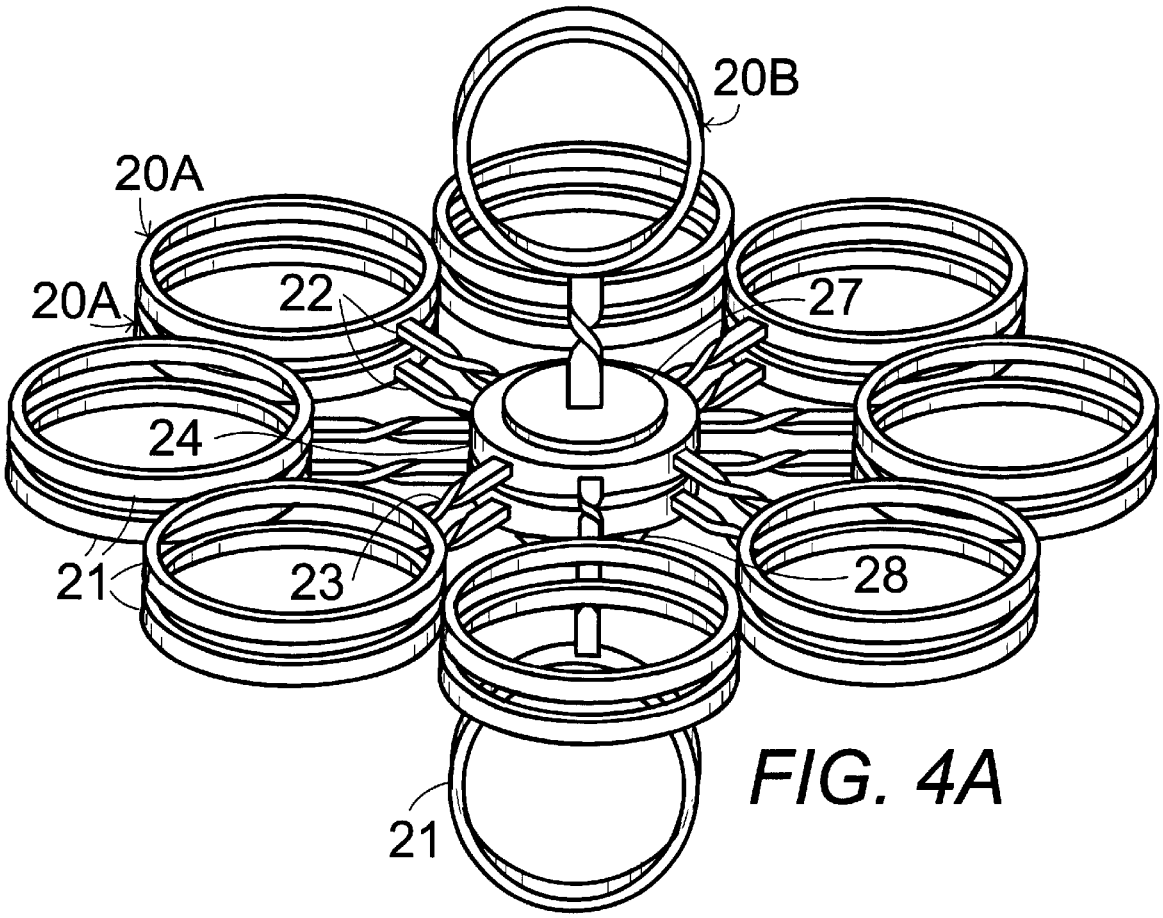
FIG. 4A is a perspective view of the multi-armed connector of FIG. 1 having the elongated double-armed connector of FIG. 1A through the central opening in the hubs of two of the multi-armed connectors.

The hubs 26 of the two-armed orthogonal connector 20B may be extended in length as in FIGS 1A and 1D or doubled with a back-to-back snap-in hub 26 as in FIGS. 1B and 1E to provide an orthogonal two-armed connector 20C, 20D, 20F, and 20G with a double connection hub which accommodates two multi-armed connectors 20A snapped onto the hub 26 of the orthogonal two-armed connector as seen in FIG. 4A. The orthogonal connectors could have longer hubs with more tabs or nibs to accommodate a larger number of multi-armed connectors 20A attached orthogonally thereto.

Figure 5:
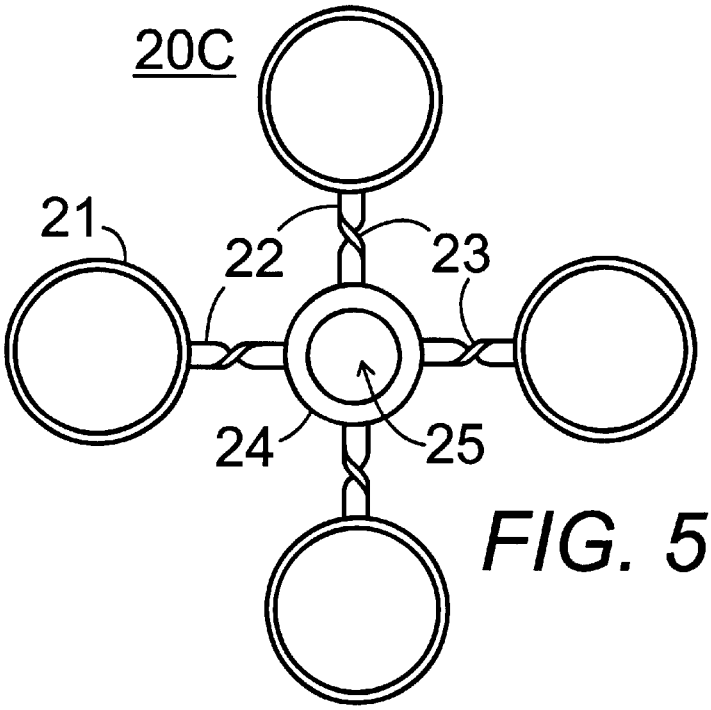
FIG. 5 is a plan view showing an alternate embodiment of the multi-armed connector of FIG. 1 having four arms.
Figure 6:
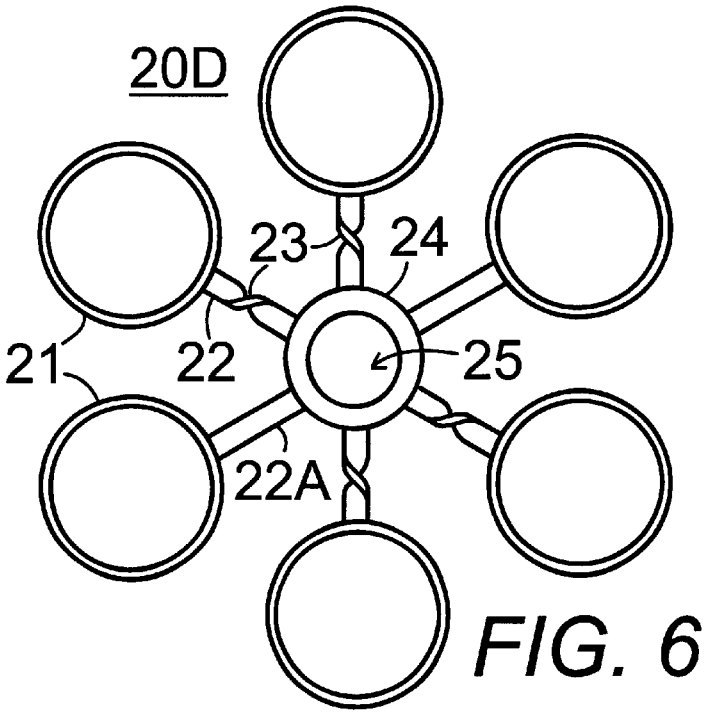
FIG. 6 is a plan view showing an alternate embodiment of the multi-armed connector of FIG. 1 having six arms with some arms having a twist and some arms straight.
Figure 7:
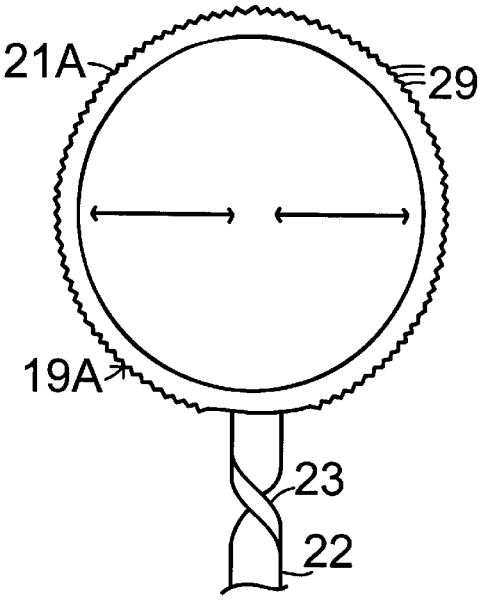
FIG. 7 is a plan view of an alternate embodiment of the arm of the connector having a flexible loop with external ridges.

In FIGS. 1–7 the preferred receiving end 19A of each of the flexible arms comprises a loop 21 formed of flexible material, the loop being capable of a range of lateral expansion and contraction, as shown by arrows in FIG. 7, up to ten times the thickness of the flexible arm, enabling the use of a very wide range of sizes of tubular building members.

In FIGS. 8–11, the receiving end 19B–19E of each of the flexible arms comprises a rod 40, 40A, and 40B having an end cap 41 and a movable washer element 18 and 18A capable of moving along the rod, as shown by vertical arrows, to compress a flexible material between the cap 41 and the washer 18 and 18A, causing the flexible material to expand, as shown by horizontal arrows, to exert a retaining force on a tubular building element inserted over the arm.

Figure 9:
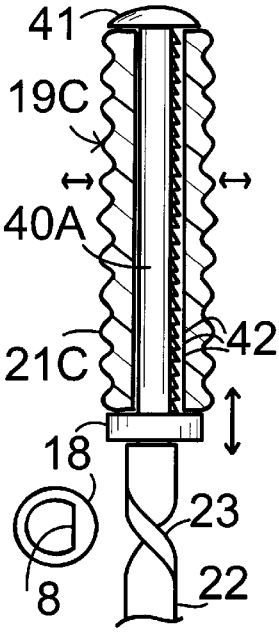
FIG. 9 is a plan view in partial section of an alternate embodiment of the arm of the connector having a rod with an end cap and teeth along its length on one side and a movable washer element capable of moving along the rod and engage the teeth to compress an expansible accordion plastic or rubber sleeve between the cap and the washer to expand the sleeve outwardly.
Figure 10:
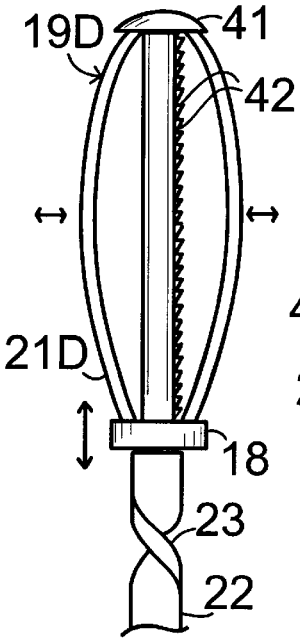
FIG. 10 is a plan view of an alternate embodiment of the arm of the connector having a rod with an end cap and teeth along its length on one side and a movable washer element capable of moving along the rod and engage the teeth to compress a series of strips of nylon cable between the cap and the washer to expand the nylon cable outwardly.

In FIGS. 9 and 10, the rod 40A has a series of teeth 42 extending longitudinally along the length of the rod and the washer 18 having a flat interior edge 8 is capable of being locked in place on the teeth.

Figure 11:
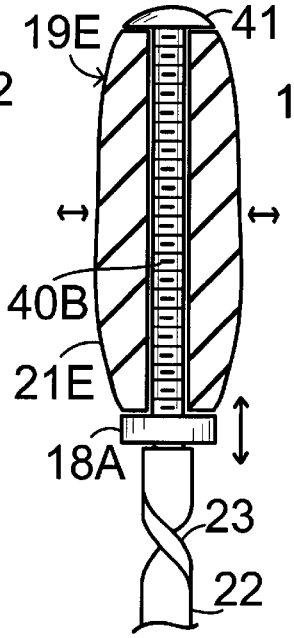
FIG. 11 is a plan view in partial section of an alternate embodiment of the arm of the connector having a threaded rod with an end cap and a movable washer element capable of moving along the rod and engage the threads to compress an expansion plastic rubber or foam sleeve between the cap and the washer to expand the sleeve outwardly.

In FIG. 11, the rod 40B is threaded and the washer 18A is capable of engaging the threads to position the washer along the rod.

Figure 8:
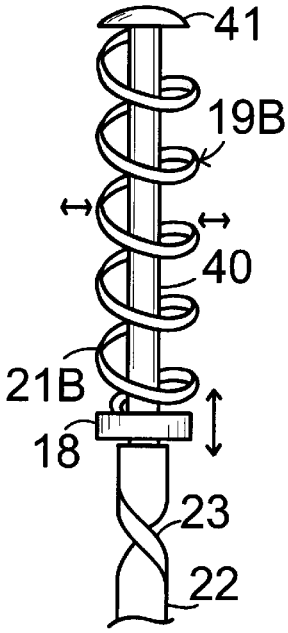
FIG. 8 is a plan view of an alternate embodiment of the arm of the connector having a rod with an end cap and a movable washer element capable of moving along the rod to compress a nylon coil spring between the cap and the washer to expand the nylon coil spring outwardly.

In FIG. 8, the flexible material is a nylon coil spring 21B encircling the rod 40.

In FIG. 9, the flexible material is a tubular configuration of expansible accordion plastic or rubber 21C.

In FIG. 10, the flexible material is a series of strips of nylon cable 21D.

In FIG. 11, the flexible material is a tubular configuration of expansion rubber or foam or plastic 21E.

Figure 12:
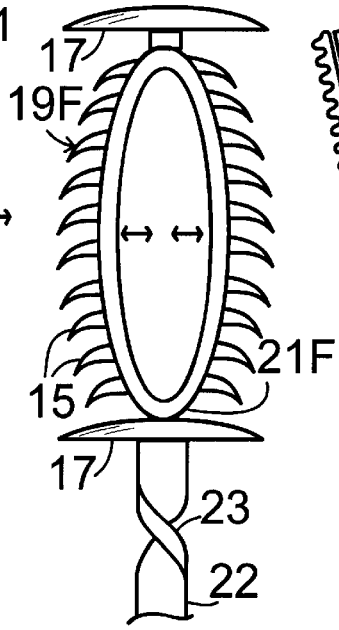
FIG. 12 is a plan view of an alternate embodiment of the arm of the connector having a flexible loop with external ribbed grips extending outwardly from the loop, the loop having a flexible cup at an outer and inner end.

In FIG. 12, the flexible material is a flexible loop 21F with external ribbed grips 15 extending outwardly from the loop, the loop being sandwiched between a flexible cup 17 at an outer and inner end, the loop being capable of being compressed or expanding over a range of distance equal to at least double the thickness of the rod, as shown by the arrows.

Figure 13:
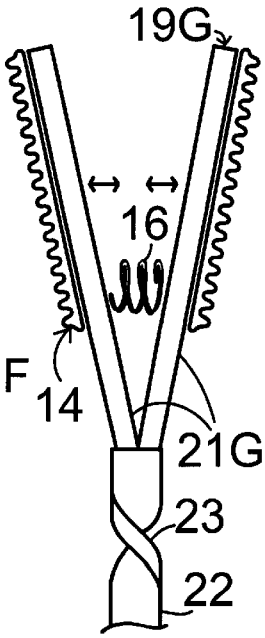
FIG. 13 is a plan view of an alternate embodiment of the arm of the connector having a spring-loaded Y-shaped split arm (nylon) with an outer rubber grip material.

In FIG. 13 the receiving end 19G of each of the flexible arms comprises a spring-loaded (by spring 16) split arm 21G having an encircling rubber grip material 14, the split arm being capable of being compressed or expanding over a range of distance equal to at least double the thickness of the rod as shown by the arrows.

Figure 14:
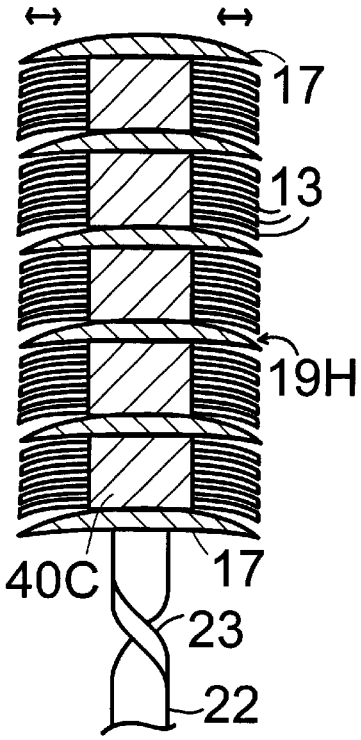
FIG. 14 is a plan view in partial section of an alternate embodiment of the arm of the connector having a rod with a series of flexible cups alternating with flexible bristles radiating out from the rod along its length.
Figure 15:
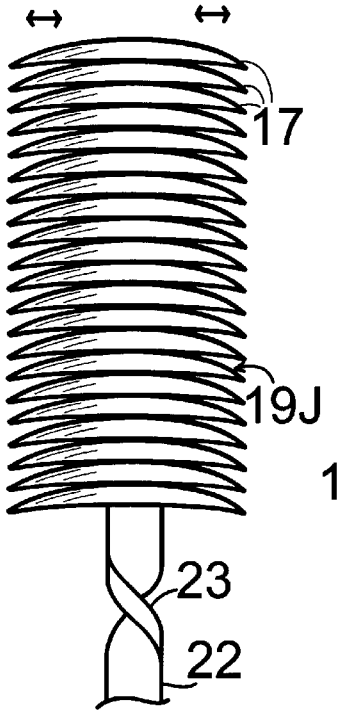
FIG. 15 is a plan view in partial section of an alternate embodiment of the arm of the connector having a rod with a series of flexible cups along its length.
Figure 16:
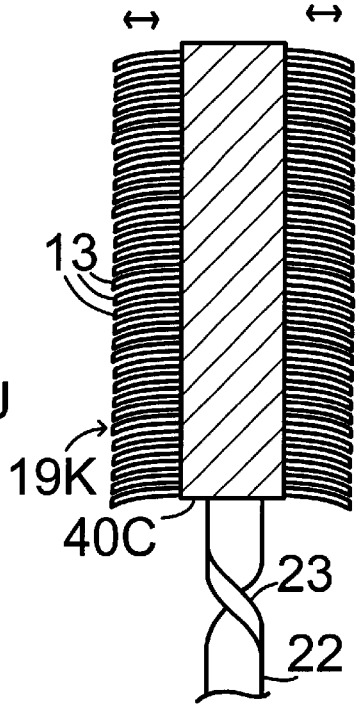
FIG. 16 is a plan view of an alternate embodiment of the arm of the connector having a rod with flexible bristles radiating out from the rod along its length.

In FIGS. 14–16 the receiving end 19H, 19J, an 19K of each of the flexible arms comprises a rod 40C having a series of flexible protrusions radiating axially out from the rod, wherein the protrusions are capable of being compressed or expanding over a range of distance equal to at least double the thickness of the rod as shown by the arrows.

In FIG. 14 the flexible protrusions comprise a series of flexible cups 17 alternating with flexible bristles 13 radiating out from the rod 40C along its length.

In FIG. 15 the flexible protrusions comprise a series of flexible cups 17.

In FIG. 16 the flexible protrusions comprise flexible bristles 13 radiating out from the rod 40C along its length.

In FIGS. 1, 2, and 3 the assortment of elongated building members 30A, 30B, and 30C having an opening 31A, 31B, and 31C at each end preferably comprise hollow tubes of varying diameters, which hollow tubes are preferably drinking straws of varying colors, lengths, and diameters.

In FIG. 5 a multi-arm connector 20C has four arms and in FIG. 6 a multi-armed connector 20D has six arms. Connectors having any number of arms are possible, limited only by the size of the arms and the space around the hub 24.

Figure 17:
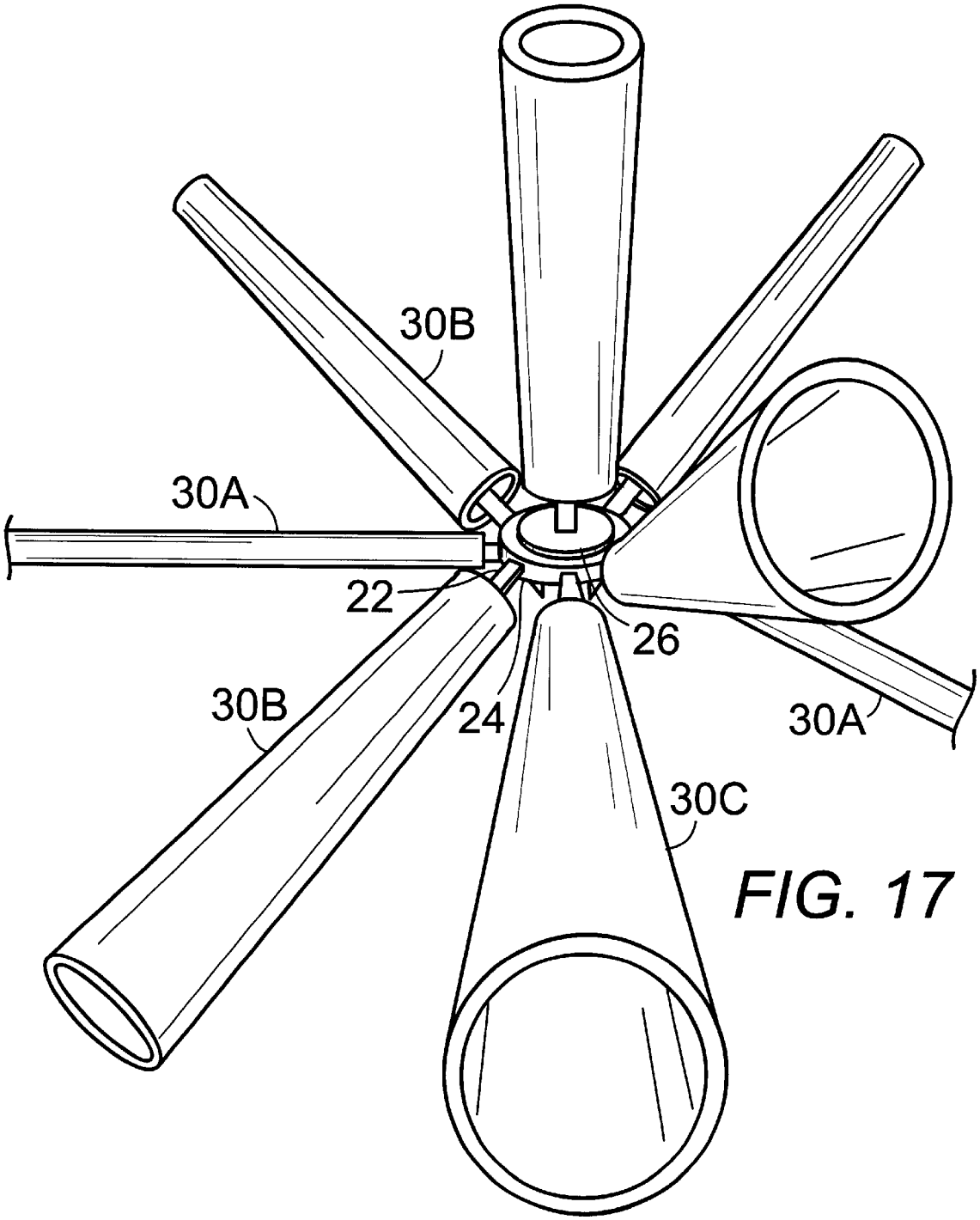
FIG. 17 is a perspective view of the combined connector of FIG. 4 showing a variety of different sizes of tubular building elements attached to the combined connector with the arms of the connectors angled out in various directions.

In FIG. 17, a multi-armed connector with hub 24 and orthogonal two arm connector having a hub 26 have a diversity of differently sized tubular building elements 30A, 30B, 30C, and 30D on the flexible arms 22 bending in a wide range of directions.

Figure 18:
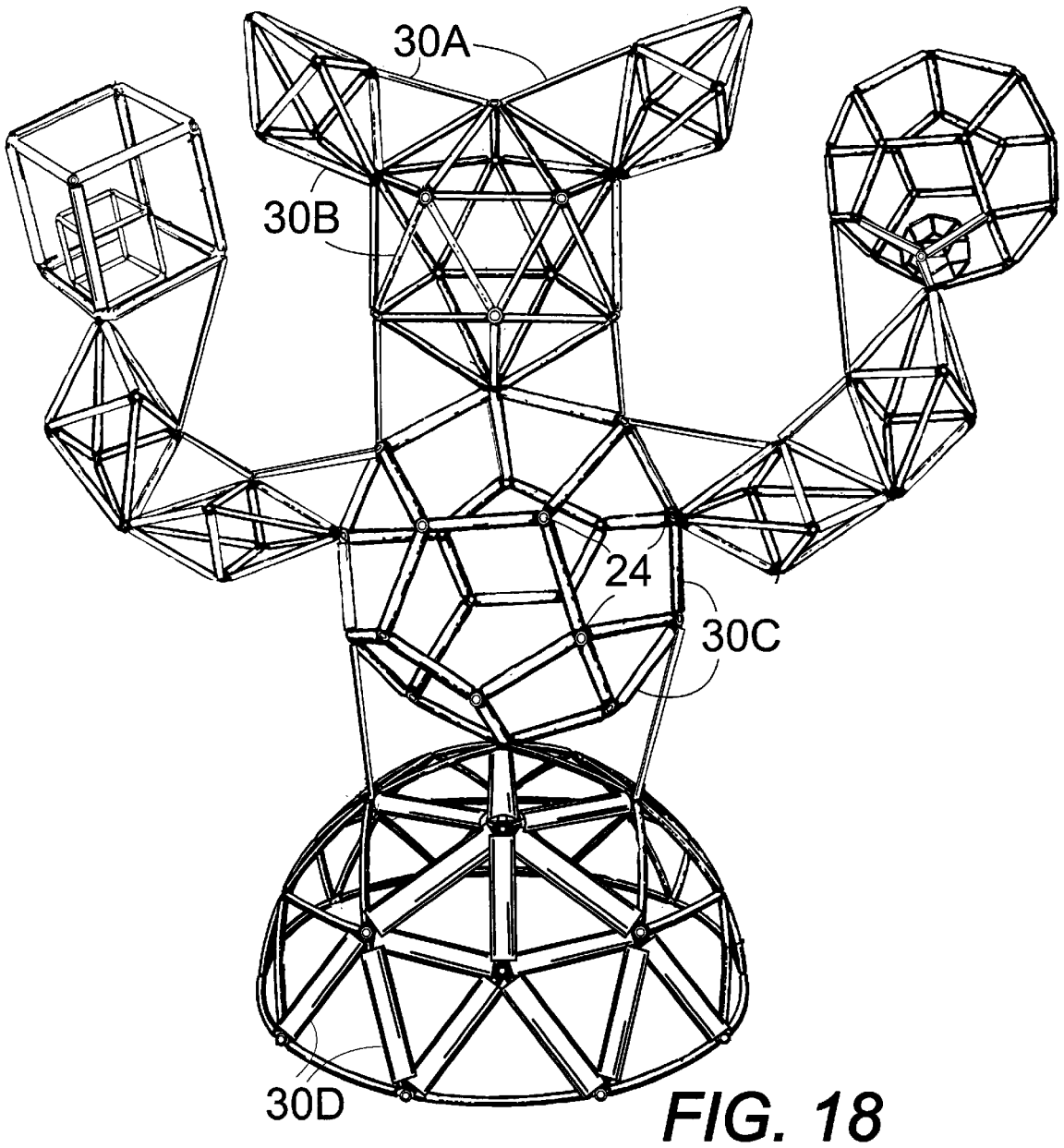
FIG. 18 is a perspective view of a space structure fabricated with the connectors and a variety of tubular building elements demonstrating the diversity of shapes that may be constructed with the system.

In FIG. 18, connectors having flexible arms varying in numbers enable a wide variety of shapes to be formed. Variously sized tubular building members 30A, 30B, 30C, and 30D (exceptionally large tubular building member) mounted on the arms and flexing in desired directions enable structures of diverse shapes and sizes. Variously colored tubular building elements of different sizes creates a great diversity of interesting structures. Because the arms are of flexible and somewhat soft plastic or nylon, they are easily cut off to simplify structures so that after a structure is built if there are extra arms without tubular building members on them, the arms may be cut off to clean up and simplify the structure.

In use any of the tubular building elements 30 A–D may be installed on any of the arms 22 and 22A over the receiving ends 19 A–K and the arms bent as desired so that the tubular building elements 30 A–D connect between connectors, which may be orthogonally interconnected as in FIG. 4, or the building elements inserted through connectors as in FIG. 3 for orthogonal connectors to create a wide variety of variably shaped space structures.

The flexibility of the connector arms 22 and 22A and the laterally expansible and contractible distal receiving ends 19 capable of a lateral expansible and contractible range of motion provide a flexible construction system which can be inexpensively molded from flexible plastic or nylon and employed with very inexpensive plastic straws of varying colors and sizes to create a very inexpensive and widely adaptable construction system to create a multitude of structural shapes for entertainment as a toy, for models of molecular and other structures in nature, and a wide range of space structures for any desired purpose. Structural strength connectors and tubular building members could enable the system to be applied to large scale structures, such as buildings. A geodesic dome is an example of such a space structure.

It is understood that the preceding description is given merely by way of illustration and not in limitation of the invention and that various modifications may be made thereto without departing from the spirit of the invention as claimed.

What is claimed is:

1. A flexible modular construction system comprising:

an assortment of elongated building members having an opening at each end;

a number of connectors each having a central hub supporting at least two flexible arms attached to the hub and extending outwardly from the hub in a spaced array, the flexible arms capable of flexing in various directions and the flexible arms each having a laterally expansible and contractible distal receiving end capable of a lateral expansible and contractible range of motion equal to at least double the thickness of the flexible arm so that each receiving end is capable of receiving and retaining any of a variety of building members having varying sizes of end openings.

2. The construction system of claim 1 wherein each of the flexible arms is formed of flexible material having at least one heat formed twist along its length so the flexible arm is capable of flexing axially as well as laterally over a wide range of motion.

3. The construction system of claim 2 wherein the receiving end of each of the flexible arms comprises a loop formed of flexible material the loop being capable of a range of lateral expansion and contraction up to ten times the thickness of the flexible arm.

4. The construction system of claim 2 wherein the receiving end of each of the flexible arms comprises a rod having an end cap and a movable washer element capable of moving along the rod to compress a flexible material between the cap and the washer, causing the flexible material to expand to exert a retaining force on a tubular building element inserted over the arm.

5. The construction system of claim 4 wherein the rod has a series of teeth extending longitudinally along the length of the rod and the washer is capable of being locked in place on the teeth.

6. The construction system of claim 4 wherein the rod is threaded and the washer is capable of engaging the threads to position the washer along the rod.

7. The construction system of claim 4 wherein the flexible material is a nylon coil spring encircling the rod.

8. The construction system of claim 4 wherein the flexible material is a tubular configuration of expansible accordion plastic.

9. The construction system of claim 4 wherein the flexible material is a tubular configuration of expansible accordion rubber.

10. The construction system of claim 4 wherein the flexible material is a series of strips of nylon cable.

11. The construction system of claim 4 wherein the flexible material is a tubular configuration of expansion material.

12. The construction system of claim 2 wherein the receiving end of each of the flexible arms comprises a rod having a series of flexible protrusions radiating axially out from the rod, wherein the protrusions are capable of being compressed or expanding over a range of distance equal to at least double the thickness of the rod.

13. The construction system of claim 2 wherein the receiving end of each of the flexible arms comprises a spring-loaded split arm having an encircling rubber grip material, the split arm being capable of being compressed or expanding over a range of distance equal to at least double the thickness of the rod.

14. The construction system of claim 2 wherein the receiving end of each of the flexible arms comprises a comprises a loop formed of flexible material with ribbed grips extending outwardly from the loop, the loop being sandwiched between an end cap and an inner ring, the loop being capable of being compressed or expanding over a range of distance equal to at least double the thickness of the rod.

15. The construction system of claim 2 wherein the assortment of elongated building members having an opening at each end comprise hollow tubes of varying diameters.

16. The construction system of claim 15 wherein the hollow tubes comprise drinking straws of varying colors, lengths, and diameters.

17. The construction system of claim 2 wherein a first hub is provided with a hub opening transversely therethrough and a second hub having only two flexible arms is insertable through the hub opening of at least one connector having a first hub with a hub opening and securable therein by a removable locking means to form a combined connector having the flexible arms of the second hub extending orthogonally to the first hub.

18. The construction system of claim 17 wherein the removable locking means comprises flexible snap-fit tabs which each engage with an edge of the hub opening after insertion.

19. The construction system of claim 17 wherein the removable locking means comprises a flexible hub with at least one protruding element which engages with an edge of the hub opening after insertion.

20. The construction system of claim 2 wherein a connector hub is provided with a hub opening transversely therethrough and a building element is insertable therethrough with a tight friction fit to expand the construction in a direction orthogonal to the connector.

* * * * *